United States Patent [19]

Malmgren et al.

[11] 4,295,900

[45] Oct. 20, 1981

[54] ROLLED WIRE HAVING A FINE-GRAIN STRUCTURE

[75] Inventors: Nils-Gunnar Malmgren; Barry Solly, both of Fagersta; Stig Tärnblom, Söderbärke, all of Sweden

[73] Assignee: Fagersta AB, Sweden

[21] Appl. No.: 909,959

[22] Filed: May 26, 1978

[30] Foreign Application Priority Data

Jun. 14, 1977 [SE] Sweden ..... 7706881

[51] Int. Cl.[3] ..... C21D 9/52

[52] U.S. Cl. ..... 148/12 B; 75/128 R; 148/38

[58] Field of Search ..... 148/38, 12 B; 75/128 R

[56] References Cited

U.S. PATENT DOCUMENTS 4,042,423 8/1977 Van den Sype et al. ..... 148/12 B

*Primary Examiner*—M. J. Andrews

*Attorney, Agent, or Firm*—Larson and Taylor

[57] ABSTRACT

A rolled wire or rod of stainless steel having a fine-grain structure and intended for the manufacture of drawn spring wire and rope wire of high mechanical strength and high ductility. The carbon content, 0.04–0.07%, is much lower than in conventional stainless steels for spring wire and rope wire, and the nickel and chromium contents, 8–9.5% and 18–19% respectively, have been adjusted to said carbon content such that a chromium content of 18% corresponds to a nickel content of 8.0–8.8% when the carbon content is 0.04% and to a nickel content of 8.8–9.5% when the carbon content is 0.07%, and a chromium content of 19% corresponds to a nickel content below 8.3% when the carbon content is 0.04% and to a nickel content of 8.4–9.2% when the carbon content is 0.07%. The grain size of the wire or rod is 8–13 ASTM, preferably 10–12 ASTM.

2 Claims, 3 Drawing Figures

% C 0,14
0,12
0,10
0,08
0,06
0 04
0,02
0
B′
B
C′
C
D
A′
A
D′
E
8,0
8,2
8,4
8,6
8,8
9,0
9,2
9,4
9,6
% Ni

σ Kp/mm2

240
ψ%
70
200
δ10%
80
60
160
60
50
120
40
80
20
40
40
0
30
0
σB
σ02
ψ
δ10
AREA
%
RED
0
20
40
60
70
80
90
10
30
50

ROLLED WIRE HAVING A FINE-GRAIN STRUCTURE

The present invention relates to hot rolled wire rod of fine-grain structure, comprising stainless steel and intended for use in the manufacture of strong and ductile spring wire and rope wire. The invention also relates to a method of manufacturing such wire rod.

The extent to which stainless steel hardens when subjected to cold working depends partly on the composition of the steel and partly on its grain size. With regard to composition, it is primarily the carbon, nickel and chromium contents of the steel which determine this degree of strain hardening. The standards for spring wire and rope wire of, e.g. type SIS 2331 (AISI 302) have wide analysis limits, which means that the properties of the drawn wire can vary considerably at the same extent of cold deformation, depending upon where within the standard the analysis lies. The most usual analysis combination, however, is one in which the steel has a high carbon content and a low nickel and chromium content, which results in rapid strain hardening. Examples of such compositions include a steel containing 0.095% C, 17.8% Cr and 8.2% Ni, or 0.11% C, 18.3% Cr and 8.5% Ni. Since a steel which has been rapidly strain hardened has a limited ductility, i.e. the wire cannot be cold worked to any great degree before it becomes brittle, a wire rod of this composition is consequently annealed. The intention herewith is to produce a coarse-grain steel, thereby improving its ductility. The grain size will lie within the range of 3–6 ASTM. Despite the coarse grain structure, it can be difficult to obtain, with this type on steel, high mechanical strength and a good ductility of the drawn wire.

The wire rod is normally annealed in the form of a coil. After a certain holding time, for example thirty minutes, at full temperature, for example 1070° C., the rod coils are cooled in a water bath. This rapid cooling is necessary in order to avoid the formation of carbides at the grain boundaries, such carbides being precipitated out in this type of steel when the holding time within a temperature range of 600°/900° C. is exessively long. The higher the carbon content of the steel, the higher the cooling rate required to avoid the formation of carbides at the grain boundaries. Because the wire rod coils are packed together during the annealing process, the rate at which the rod laps lying within the coils are cooled is much slower than the outermost rod laps which are in direct contact with the cooling water. Thus, the rate at which the inner laps are cooled is so slow that it is impossible to avoid the formation of carbides at the grain boundaries even when the carbon content is as low as 0.08%.

One method of avoiding the formation of grain-boundary carbides when annealing hot rolled wire rod is to carry out a strand anneal. In such an annealing process, the rod coil is unwound and the rod allowed to pass through an elongate, tubular furnace with subsequent water-cooled regions, whereafter the wire rod is again coiled. With this type of annealing process, each cross-section of the wire is subjected to the same time/-temperature cycle and the cooling rate is sufficiently high to avoid the formation of grain/boundary carbides, even with a carbon content as high as 0.15%. The disadvantage with strand annealing, however, is that the production rate is low and the problems of handling the rod great, which increases production costs.

One method of solving the problem relating to grain-boundary carbides would be to lower the carbon content to beneath 0.08%. Since, however, it is necessary to anneal the hot rolled wire rod in order to obtain uniform grain size and thereby uniform mechanical strength along the wire rod, it is difficult with coarse-grain material to obtain the desired mechanical strength in the drawn wire at such low carbon contents; the reason for this is that the extent to which the steel is strain hardened rapidly decreases at carbon contents beneath 0.08%.

An aim of the present invention is to solve the aforementioned problems and to provide hot rolled stainless steel wire rod which, when drawn to spring wire and rope wire, exhibits a high mechanical strength and good ductility. A further object of the invention is to provide a method of manufacturing such hot rolled wire or rod.

The objects of the invention are fulfilled by means of a hot rolled wire or rod having a specific combination of composition and grain size, said hot rolled wire rod being characterised by the fact that it contains 0.04–0.07% C, 18–19% Cr and 8–9.5% Ni, and by the fact that the grain size is 8–13 ASTM. In the method according to the invention, the hot rolled wire rod is cooled directly subsequent to leaving the finishing rolling stand of a rolling mill for example first with water in a continuous cooling train from the final-rolling temperature to approximately 700°–750° C., whereafter the wire or rod is led through a coiler and the coils of wire rod pass through an air-cooling zone in which the growth of the grains in the hot rolled wire rod is suppressed.

So that the invention will be more readily understood and optional features thereof made apparent, an exemplary embodiment of the invention will be made with reference to the accompanying drawing in which a comparison is made between the properties of hot rolled wire rod annealed in accordance with conventional methods and a hot rolled wire rod manufactured in accordance with the invention.

Figure 1:
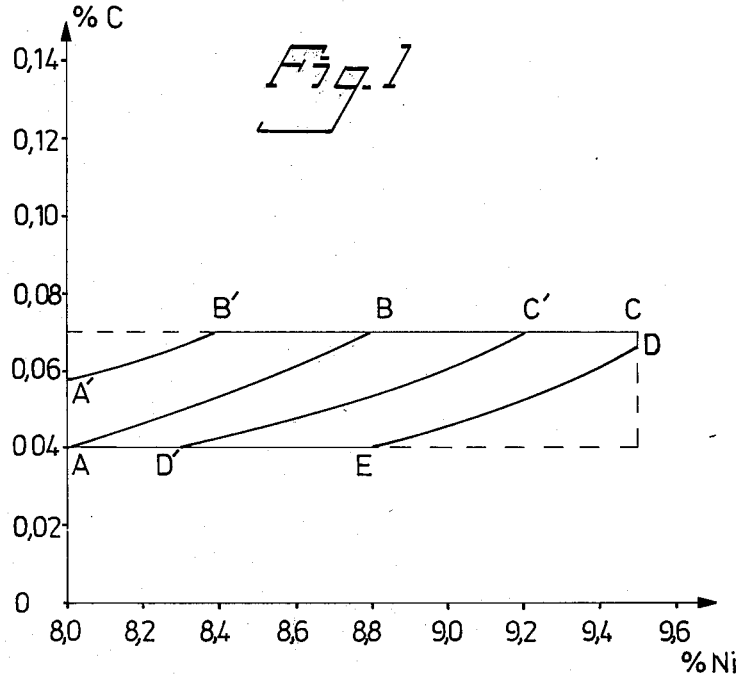
FIG. 1 is an analysis of the wire or rod of the invention wherein the region A, B, C, D and E indicates the combination possibilities for C and Ni with a minimum Cr content of 18.0% and the region A,' B,' C,' D,' A' indicates the combination possibilities for C and Ni with the maximum content of 19.0%.

When a conventional, high-carbon hot rolled stainless steel wire rod is cooled in the manner effected with wire rod according to the invention there is obtained a very fine grain material, having a grain size of 10–12 ASTM. Thus, the rapid cooling ensures that the grains are unable to grow, which means that the wire rod obtains, compared with conventionally annealed wire rod, a higher degree of mechanical strength and, thereby, unfortunately also a more limited ductility or drawability. One advantage obtained, however, is that with the rapid cooling of the wire rod, each cross-section thereof undergoes the same time/temperature sequence, which provides a more uniform grain size and therewith a more uniform mechanical strength along said wire rod. In addition, the problems related to grain-boundary carbides disappear. In order to be able to utilise these obvious advantages, it is necessary with regard to rolled wire rod intended to be drawn to rope wire and spring wire, to solve the problem relating to the limited ductility or drawability. According to the invention this problem has been solved by promoting a new analysis in which the carbon content has been lowered to 0.04–0.07% and the nickel and chromium contents have been adjusted to this carbon content in the manner illustrated in FIG. 1. The combination of these elements shall lie within the region illustrated by FIG. 1, the region A,B,C,D,E indicating the combination possibilities for C and Ni with the minimum content of Cr being 18.0%. The region A',B',C',D',A indicates the combination possibilities for C and Ni with the maximum content of Cr = 19.0%. The combination possibilities for C and Ni with chromium contents between 18 and 19% are obtained by interpolation between the two regions. The reason with this limitation of the basic analysis is to obtain a well-balanced strain hardening. The carbon content is much lower than in the case with conventional analyses for spring wire and rope wire of stainless steel, but nevertheless it still provides a wire having the desired high mechanical strength and good ductility. The composition of a hot rolled wire rod according to the invention is 0.04–0.07% C, 18–19% Cr and 8–9.5% Ni, the content of remaining alloying and impurity elements, such as Si, Mn, P and S are selected so that, together with C, Cr and Ni they provide an analysis which covers the standards for SIS 2331 (AISI 302) and SIS 2332, and partly SIS 2333 (AISI 304).

A hot rolled wire rod having the given analysis and which has been cooled by means of the method according to the invention obtains a higher ductility or drawability than a conventional high-carbon, annealed hot rolled wire rod. This means that it is possible to take larger total reductions when drawing, i.e. to obtain smaller dimensions with higher mechanical strength and better ductility.

Figure 2:
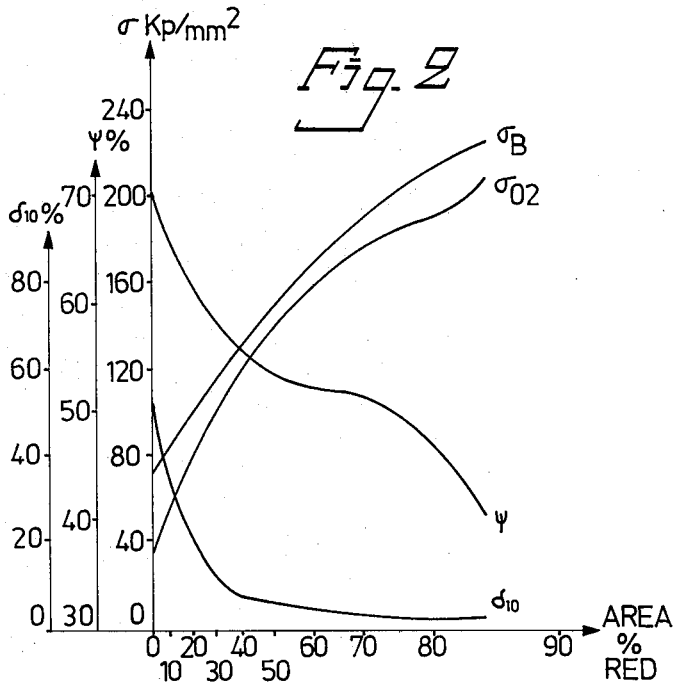
FIG. 2 is a graph of the properties resulting when drawing a conventional, annealed, rolled wire rod.
Figure 3:
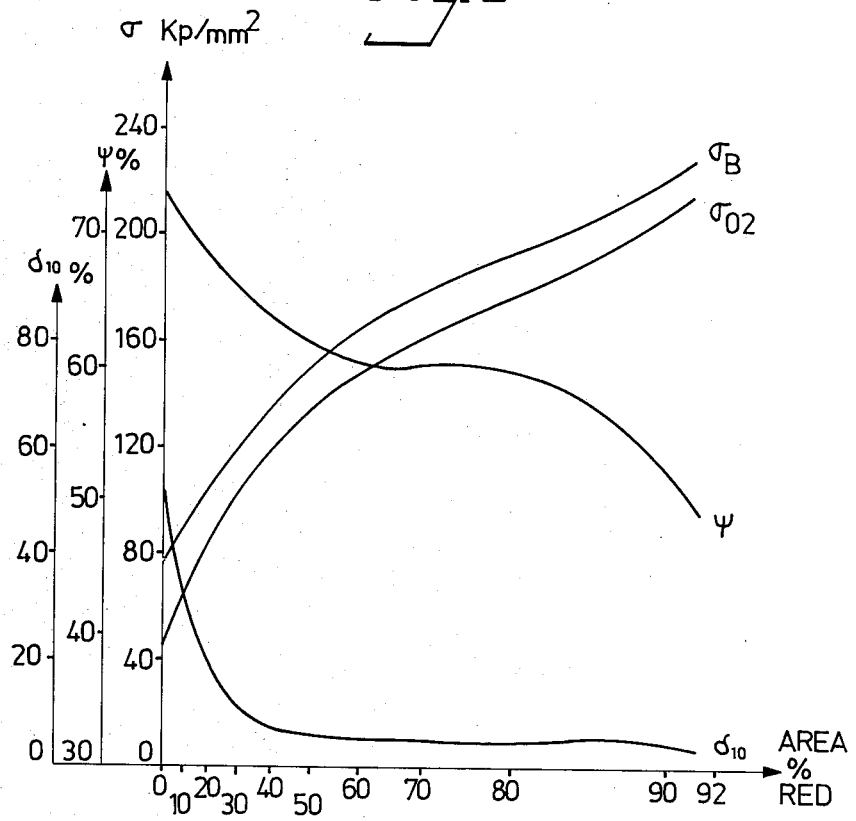
FIG. 3 is a graph of the properties resulting when drawing a rolled rod of the invention.

The difference in properties when drawing between a conventional, annealed hot rolled wire rod with a rapid strain hardening process, and a hot rolled wire rod according to the invention with a slower strain hardening, will be seen from FIG. 2 and FIG. 3, respectively. The diagrams illustrate tensile strength $\sigma_B$, 0.2-limits $\sigma_{0.2}$, contraction $\psi$ and extension $\delta_{10}$ as a function of the reduction in area in percent when drawing from a hot rolled wire rod dimension of $\phi$5.6 mm. With a reduction of 80–85%, the contraction falls rapidly in the case of the conventional hot rolled wire rod, and is down to 40% at a reduction of 85%. The hot rolled wire rod according to the invention, which has been drawn to a reduction of 91.4%, still has a higher mechanical strength and the same contraction as the conventional material at a reduction of 76%.

In order to obtain very small dimensions when drawing, e.g. 0.20 mm, a number of intermediate annealing operations are required, although as a result of the improved ductility of the low-carbon rolled wire or rod according to the invention, the number of annealing operations can be reduced compared with conventional material. When drawing hot rolled wire rod according to the invention down to small dimensions, it has surprisingly been found that the fine-grain effect on the wire rod remains and is even strengthened after the intermediate annealing operation.

By way of summary it can be said that a hot rolled wire rod according to the invention reduces the risk of grain-boundary carbides forming because of the low carbon content of the wire rod; provides improved fatigue values, because of the fine grain structure of said wire rod; provides a more uniform mechanical strength throughout the wire rod, because of the slow strain hardening; is less sensitive to the affect of the drawing temperature on the strain hardening; enables higher productivity in the strand annealing furnaces owing to larger dimensions at intermediate annealing processes; and enables drawing and annealing operations to be removed within certain dimension intervals.

We claim:

1. A hot rolled wire rod of fine-grain structure consisting of stainless steel and intended for the manufacture of drawn spring wire and rope wire of high mechanical strength and high ductility, characterized in that said wire rod contains 0.04–0.07% C, 18–19% Cr and 8–9.5% Ni wherein a Cr-content of 18% corresponds to a Ni-content of 8.0–8.8% when the C-content is 0.04% and to a Ni-content of 8.8–9.5% when the C-content is 0.07%, and a Cr-content of 19% corresponds to a Ni-content of below 8.3% when the C-content is 0.04% and to a Ni-content of 8.4–9.2% when the C-content is 0.07%, said wire rod having a uniform grain size along said wire rod, said grain size being 8–13 ASTM.

2. A hot rolled wire rod according to claim 1 having a grain size of 10–12 ASTM.

* * * * *